US006013867A

United States Patent [19]

Isaka

[11] Patent Number: 6,013,867

[45] Date of Patent: Jan. 11, 2000

[54] DISK MUSIC BOX

[75] Inventor: Akihiko Isaka, Nagano, Japan

[73] Assignee: Sankyo Seiki Mfg. Co., Ltd., Nagano-ken, Japan

[21] Appl. No.: 08/997,937

[22] Filed: Dec. 24, 1997

[30] Foreign Application Priority Data

Dec. 25, 1996 [JP] Japan ..... 8-345247
Dec. 25, 1996 [JP] Japan ..... 8-345248

[51] Int. Cl.[7] ..... G10F 1/06

[52] U.S. Cl. ..... 84/97

[58] Field of Search ..... 84/94.1, 94.2, 84/95.1, 95.2, 97, 98, 99, 100, 101, 96

[56] References Cited

U.S. PATENT DOCUMENTS

| | | | |
|---|---|---|---|
| 500,371 | 6/1893 | Brachhausen et al. | 84/98 |
| 538,468 | 4/1895 | Schaub | 84/98 |
| 550,154 | 11/1895 | Bernard | 84/98 |
| 559,183 | 4/1896 | Main | 84/98 |
| 574,758 | 1/1897 | Paoli | 84/98 |
| 2,780,952 | 2/1957 | Haricot | 84/97 |
| 3,559,525 | 2/1971 | Fishbein | 84/98 |
| 3,710,668 | 1/1973 | Van Sice et al. | 84/98 |
| 3,747,459 | 7/1973 | Schmidt et al. | 84/94 R |
| 4,114,895 | 9/1978 | Eckhart | 274/23 R |
| 4,423,501 | 12/1983 | Cadawas | 369/253 |
| 4,466,328 | 8/1984 | Kitamura | 84/98 |
| 4,539,672 | 9/1985 | Einhaus | 369/244 |
| 5,864,519 | 1/1999 | Nakamura | 368/10 |

FOREIGN PATENT DOCUMENTS

| | | |
|---|---|---|
| 111091 | 6/1999 | Germany . |
| 7-34464 | 8/1995 | Japan . |
| H7-34464 | 8/1995 | Japan . |
| 09097052 | 4/1997 | Japan . |
| 9-97054 | 4/1997 | Japan . |
| H9-97054 | 4/1997 | Japan . |
| 09319362 | 12/1997 | Japan . |

*Primary Examiner*—Robert E. Nappi
*Assistant Examiner*—Wesley Scott Ashton
*Attorney, Agent, or Firm*—McAulay Nissen Goldberg Kiel & Hand, LLP

[57] ABSTRACT

A disk music box comprises a center shaft, around which a disk is rotated by being engaged with the center shaft. The disk has a plurality of engagement portions which correspond to a music selection. A reed portion is included which comprises a comb having reeds arranged like a comb. Further, the disk music box comprises a pin shaft which is arranged opposite the disk and a plurality of pinwheels which plays a melody by playing the reeds. The pinwheels are rotated while being engaged with the engagement portions of the disk. The disk music box also comprises an arm having a tip and a base end. The arm is rotatably supported against a base so that the base end remains within a plane which is almost perpendicular to the disk. The tip is engaged with the center shaft to be arranged opposite the pin shaft. A contact member is included which is rotatably supported by the arm so that it can contact the disk. A transmission device transfers force from the arm to the pin shaft. The arm is formed to be movably in parallel with the center shaft.

13 Claims, 11 Drawing Sheets

DISK MUSIC BOX

BACKGROUND OF THE INVENTION a) Field of the Invention

The present invention relates to a disk music box which plays reeds by rotating a plurality of pinwheels at a plurality of engagement portions arranged on a disk so that they play a music.

b) Description of the Related Art

A popular disk music box drive a disk which is formed with an engagement portion (e.g. a plurality of holes or convexities) which plays music so the engagement portion plays reeds while a plurality of pinwheels are rotated. A spacer is arranged in each of the pinwheels in the music box for maintaining a predetermined space therebetween. However, putting them in the music box is an elaborate work. As one of the solution for the problem, a disk music box is disclosed in Japanese Utility Model H7-34464. The pinwheels and pin shaft are supported by partitions, which forms a plurality of spaces in the shaft direction, and a housing formed integral with a bearing, which supports the pin shaft. In the housing, projections control rotation of pinwheels by being engaged/disengaged with the same.

To maintain the engaged state of the disk and pinwheels constant, generally, force from a disk is urged in the direction farther from pinwheels by bending the circumference sides of pinwheels of the disk upward via a guiding member. At the same time, a flat portion is formed at the portion opposite the pinwheels, onto which a rollers formed on the arm are pressed to transmit force in the direction the disk becomes closer to the pinwheels. This configuration is too complex to make adjustment; this is a problem.

In the disk music box disclosed in Japanese laid open patent H9-97054, a plurality of press rollers which contact the disk is rotatably formed on the arm such that the press rollers are arranged opposite the pinwheels to guide the disk. In other words, the arm is rotatably supported by a shaft which is fixed onto a pillar formed on the music box frame. By having the lever formed on the tip of the frame being engaged with the center shaft on which the disk is attached, a plurality of rollers are aligned and press the disk. To remove the disk from the disk music box, the engagement between the center shaft and the lever is released and the arm is rotated such that it retreats from the disk. Then, the disk is taken out from the center shaft.

A music box of conventional technology is supported by the bearing surface formed on the housing which holds the pinwheels shaft, which is made of a resin. Therefore, the rigidity of the housing or mounting portion of the pin shaft have poor rigidity. If the housing or pin shaft mounting portion have poor rigidity, the pin shaft will retreat when the pinwheels play the reeds; this creates dull sound, which is a poor sound quality. Especially, when a plurality of pinwheels play a plurality of reeds, a heavy load is placed on the pin shaft, making the sound significantly poor. An idea to improve the sound quality is to form the housing body integral with the frame. However, the pinwheels are thin because they are formed to be as many as the number of reeds. As a result, narrow partitions must be machined; and this machining is difficult.

The movement control projections play a melody when the pinwheels rotate due to engagement with the projections. The contacting sound (played sound) turns into noise, degrading sound quality. The guiding member which curves the disk is formed on a frame, the disk loading space must be provided on the frame; this makes it difficult to reduce the size of the music box. If a guiding member and a disk are together made of a metallic material, both abrade and wear out as the disk rotates; this makes it difficult to position the disk appropriately and affects the durability of the disk.

When a motor is the disk drive source, a larger load increases power consumption; this decreases the usable life time of the disk music box.

Also, because the arm is simply rotatably supported by the shaft of the pillar, the arm motion cannot be stopped in the middle of rotation. This makes it difficult to remove/place the disk. When the music box operator stops rotating the arm, the arm may continue rotating by its own weight, contacting the housing or disk, damaging the arm, disk, or housing.

OBJECTS AND SUMMARY OF THE INVENTION

A first object of the present invention is to provide an easy-to-assemble, durable disk music box of excellent sound quality.

A second object of the present invention is to provide a low power and smooth rotation disk music box in which the engagement of disk and pin portion is secured.

A third object of the present invention is to provide an easy-to-place and damage free disk music box.

In accordance with the invention, a disk music box comprises a center shaft, around which a disk is rotated by being engaged with the center shaft. The disk has a plurality of engagement portions which correspond to a music selection. A reed portion is included which comprises a comb having reeds arranged like a comb. Further, the disk music box comprises a pin shaft which is arranged opposite the disk and a plurality of pinwheels which plays a melody by playing the reeds. The pinwheels are rotated while being engaged with the engagement portions of the disk. The disk music box also comprises an arm having a tip and a base end. The arm is rotatably supported against a frame so that the frame with center shaft to be arranged opposite the pin shaft. The tip is engaged with the center shaft to be arranged opposite the pin shaft. A contact member is included which is rotatably supported by the arm so that it can contact the disk. A transmission means urges force from the arm to the pin shaft. The arm is formed to be movably in parallel with the center shaft.

DESCRIPTION OF THE PREFERRED EMBODIMENTS

Figure 1:
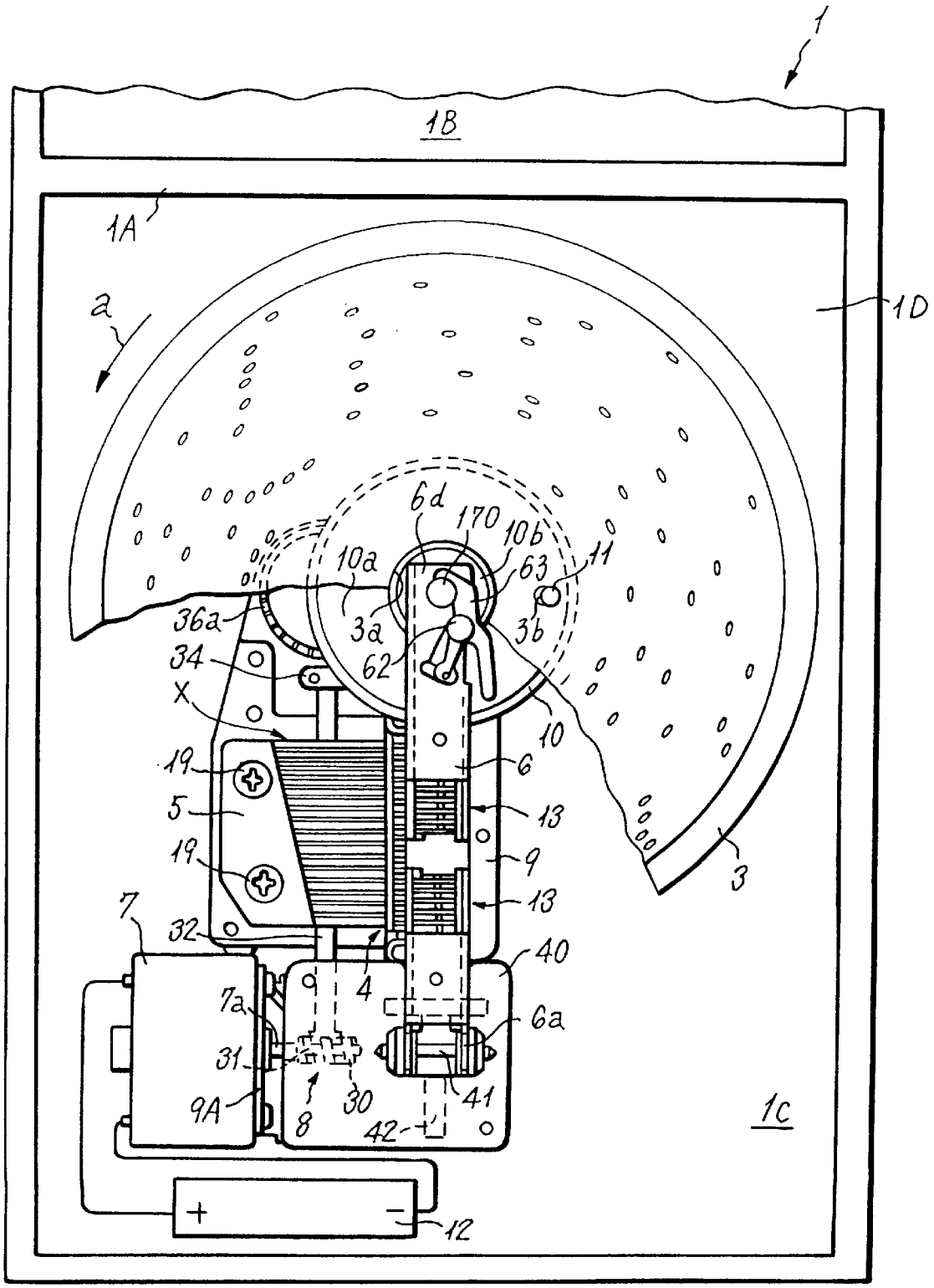
FIG. 1 is a plan view of a disk music box of Embodiment 1 of the present invention.

The disk music box shown in FIG. 1 is stored in a wooden case 1, which is a housing. Case 1 is divided by partition wall 1A into upper chamber 1B and lower chamber 1C. The disk music box is secured against back 1D of lower chamber 1C with screws. In upper chamber 1B, a clock unit (not illustrated) is installed. A lid (not illustrated) is attached on case 1. Note that case 1 can be made of resin or metal and the like, other than wood.

Figure 2:
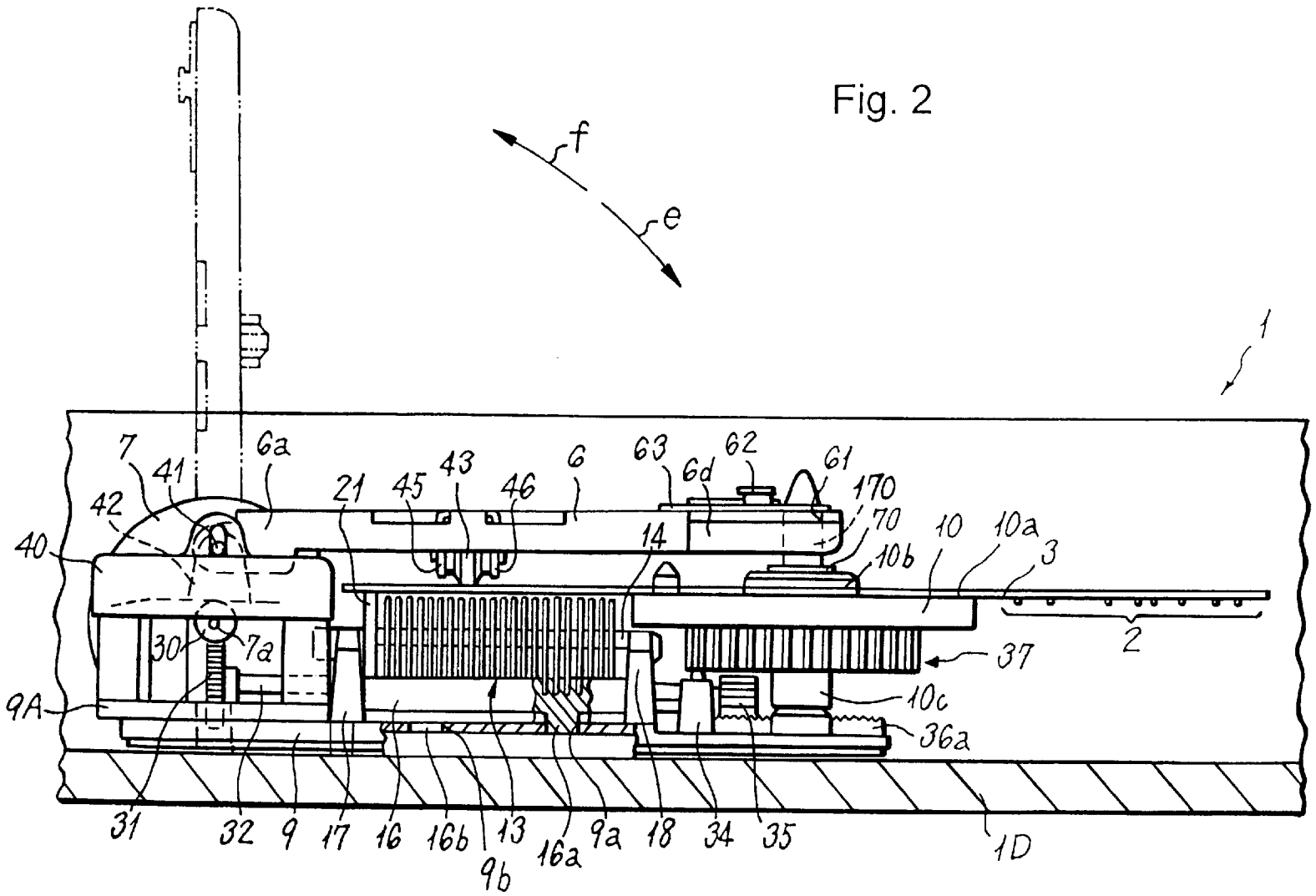
FIG. 2 is a partial front view showing the layout of the disk music box and how it is housed.
Figure 3:
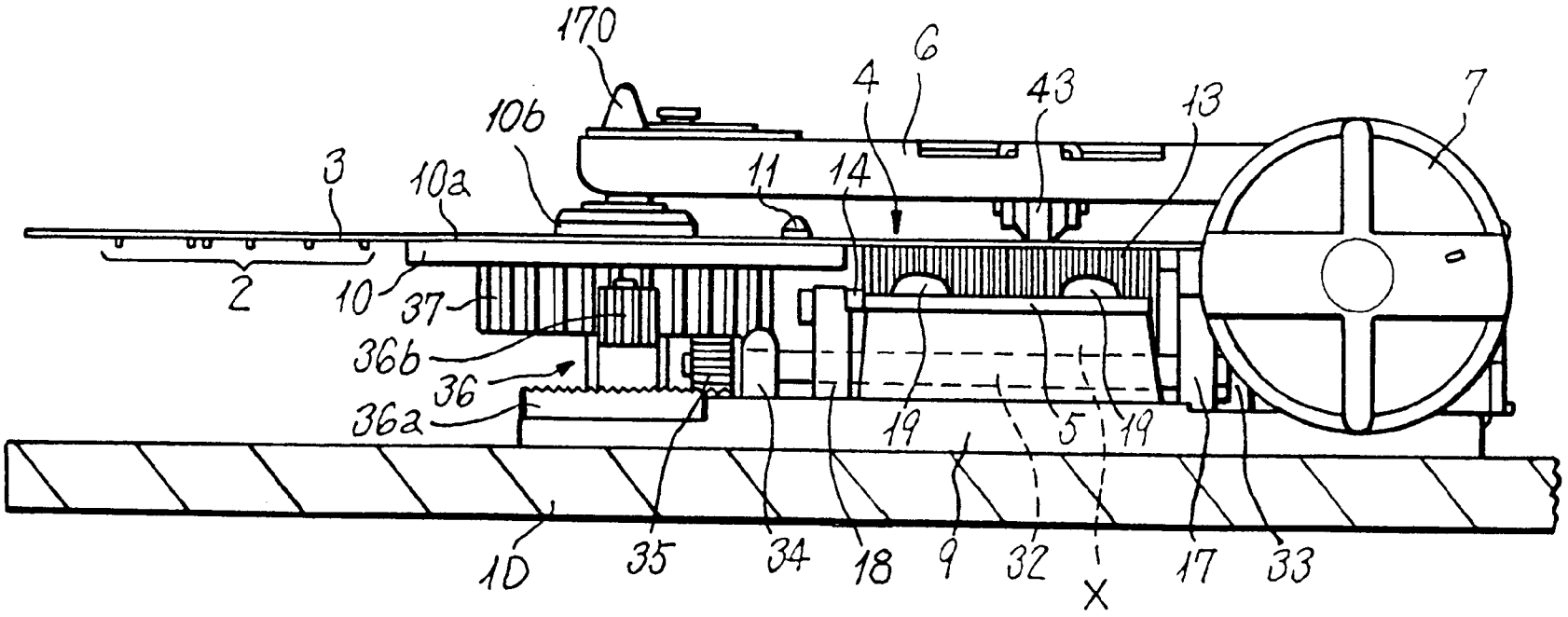
FIG. 3 is a back side view showing the configuration of the disk music box.

As shown in FIGS. 2 and 3, a disk music box comprises:

disk 3 which is formed with a plurality of projections 2, which constitute engagement portions;

pinwheels unit 4, which engages projections 2;

comb 5;

arm 6;

driving motor 7, which is a normally/reversibly rotatable source of driving, and loader 10 on which disk 3 is loaded.

The major parts except disk 3 are placed on frame 9 made of zinc diecast alloy, which is the base of the music box. Frame 9 also has a function of resonating the vibrations from comb 5. L-shaped base plate 9A is fixed on one end of frame 9, positioned external to circumference of disk 3, and center shaft 170 is journaled on the other end of frame 9. One surface of L-shaped base plate 9A supports motor 7 and the other surface is supported by frame 9. Power source 12 for motor 7 is arranged below lower chamber 1C.

The disk 3 of the present invention is a metallic plate (e.g. SUS) 0.4 mm thick with a diameter of 12 cm, which is the same as a compact disk (CD). Disk 3 may be made of plated iron. If the diameter of disk 3 is made equal to that of a compact disk, disk 3 can be stored in a ready made CD case; this advantageously reduces shipping cost and storage cost for disk 3. Center hole 3*a* is formed in the center of disk 3. Center hole 3*a* is contactingly fitted along circumference of cylindrical portion 10*b* formed in the center of loader surface 10*a* of loader 10. Also disk 3 has an elongated hole 3*b* and elongated hole 3*b* is engaged with pin 11 which is formed on the loader surface 10*a*. Thus disk 3 is guided in the radius direction with respect to loader 10 such that it can rotate integral with loader 10. Projections 2 of disk 3 are engagement portions to play music, which are formed by punching through the surface of disk 3 and punching out a part of the surface. The engagement portions are not limited to projections. They can be holes only, which are formed by pressing or punching disk 3.

Loader 10 is rotatably supported by center shaft 170 which cylindrical portion 10*b* fitted from the top to center shaft 170. Boss portion 10*c* is integrally formed with loader 10 at the bottom. Boss portion 10*c* contacts frame 9 through center shaft 170. Loader surface 10*a* is aligned above the circumference of pinwheels 13. Loader 10 is fitted on the circumference surface of center shaft 170 and E-ring 70 is fitted directly above cylinder portion 10*b* to regulate the movement in the shaft direction.

Pinwheels unit 4 are arranged below disk 3. Pinwheels unit 4, in major part, comprises a plurality of pinwheels 13 which engage projections 2 pin shaft 14 which rotatably supports the plurality of pinwheels 13 and housing 16 with a plurality of partitions 15 which maintains a plurality of pinwheels 13 at predetermined positions. (see FIG. 4)

Comb 5 comprises a plurality of reeds 5*a* in a comb shape and is fixed with screw 19 such that the tips 5*b* of reeds 5*a* are positioned within the range of the pinwheels 13 rotations. Tips 5*b* of comb 5*a* are formed such that they are at the same level as pin shaft 14. Space X is formed (See FIGS. 1 and 3) between comb 5 and frame 9.

Figure 9:
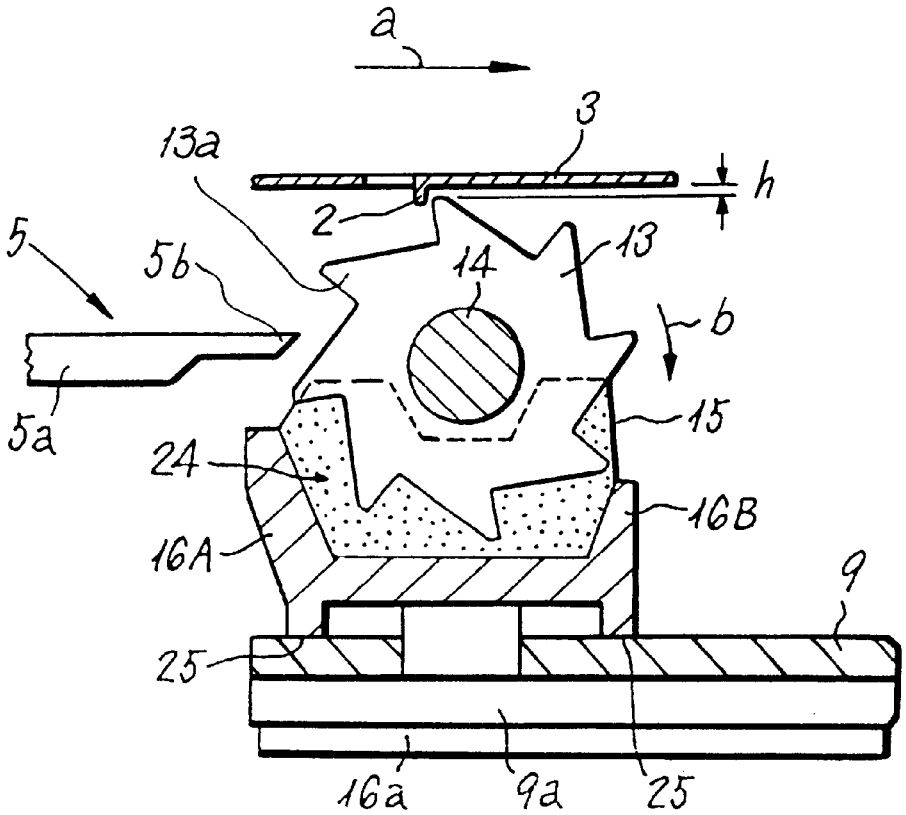
FIG. 9 is a magnified cross section showing the layout of pinwheels, reeds, and a disk and how they work.

Each of the pinwheels 13, which are provided to be as many as there are reeds 5*a* of comb 5, is made of metallic material and is independently rotatably supported by pin shaft 14. Pinwheels 13 are formed with a plurality (8 in this embodiment) of pins 13*a*, as shown in FIG. 9. Pins 13*a* engage projections 2 of disk 3. When projections 2 move in the direction marked with arrow (a) as disk 3 rotates, one of pinwheel 13 rotates in the direction marked with arrow (b) by a predetermined angle to pick (play) tip 5*b* of reed 5*a* at its lower end.

Figure 4:
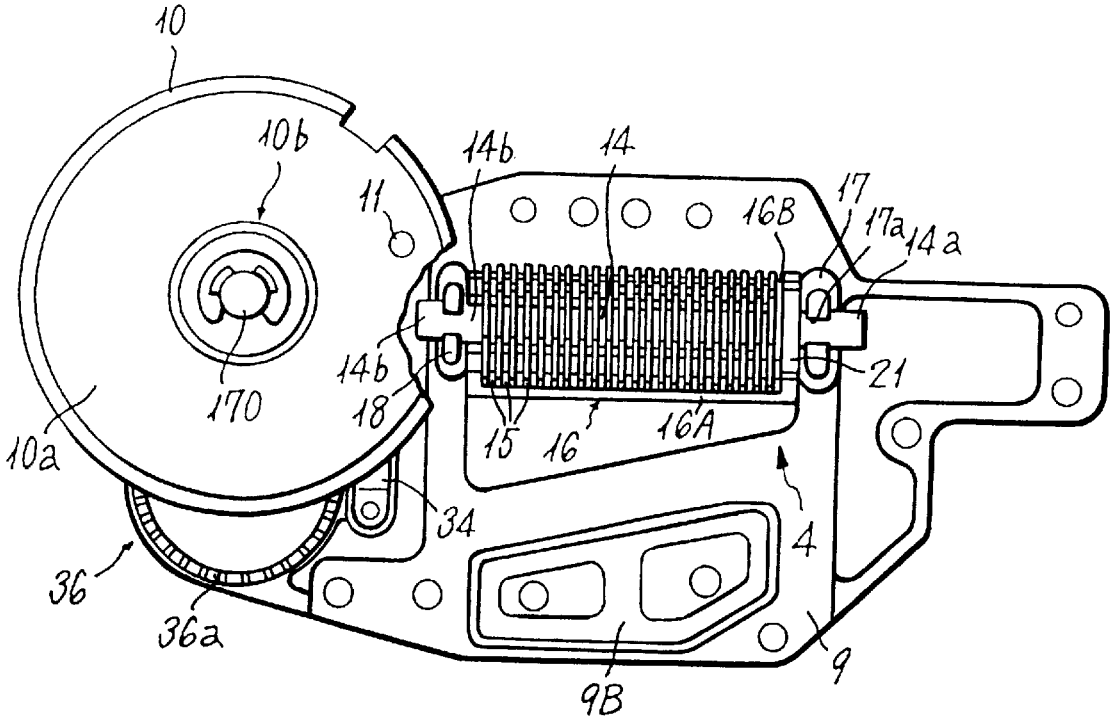
FIG. 4 is a plan view showing the configuration of the pin shaft supporting pinwheels, a major portion of the present invention and how it is installed.
Figure 5:
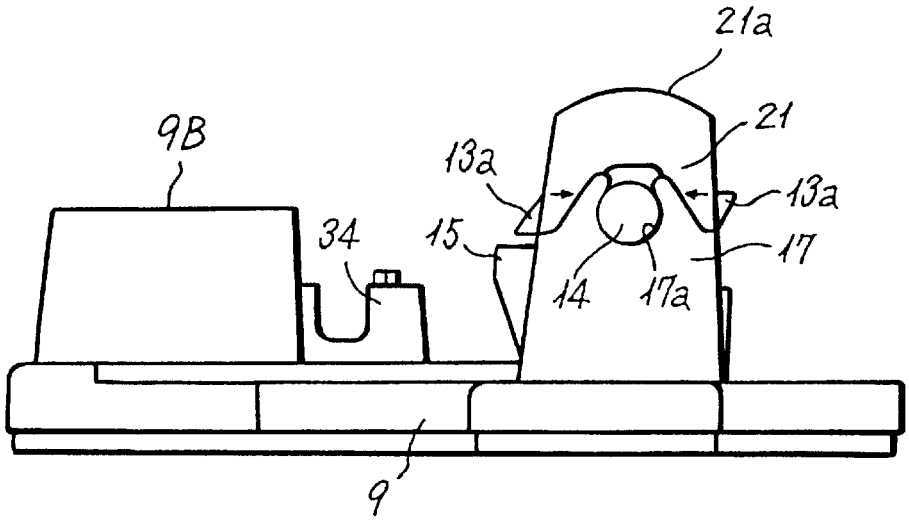
FIG. 5 is a side view showing how bearings support the pin shaft.

Pin shaft 14 is made of metallic material and both its ends 14*a*, 14*b* are supported by bearings 17, 18 as shown in FIGS. 4 and 5. Bearings 17, 18 are made of metallic material and are formed opposite each other on frame 9 on the sides of housing 16. Note that in this embodiment, bearings 17, 18 are formed on and integral with frame 9. U-shaped openings 17*a*, 18*b* are formed on top of bearings 17, 18 opposite disk 3. Pin shaft 14 is inserted from the top through U-shaped openings 17*a*, 18*a* and is tightened in the shaft center direction of pin shaft 14 from the sides of bearings 17, 18 to be supported by bearings 17, 18.

Figure 6:
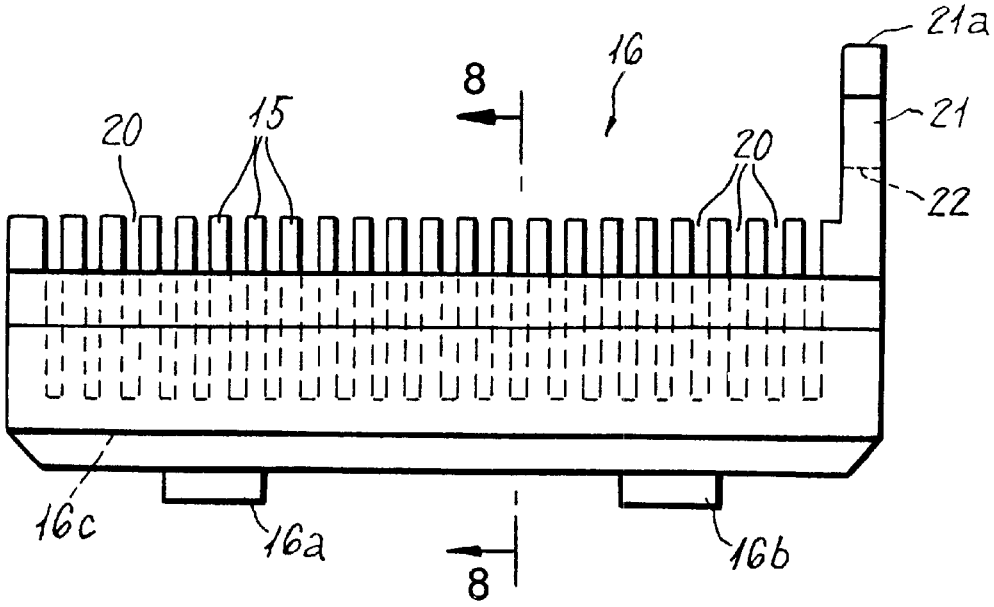
FIG. 6 is a front view showing the configuration of the housing in which pinwheels are inserted.

Housing 16 is a box like member extending in the shaft direction of pin shaft 14. Its length is set the same as the distance between bearings 17,18. Inside of housing 16, as shown in FIG. 6, a plurality of partitions 15 are formed like a comb. Partitions 15 are arranged in parallel in the shaft direction at a predetermined distance. Spaces 20 between each of the partitions 15 are somewhat wider than the thickness of pinwheels 13. Partitions 15 are formed for inserting pinwheels 13 into each of the spaces 20 to prevent pinwheels 13 from sliding in the axial direction and to hold pinwheels 13 on pin shaft 14 at a predetermined location. In the center of each of the partitions 15, concavities 23 are formed such that they do not contact pin shaft 14 supported by bearings 17, 18, as shown in FIGS. 7 and 8.

Boss portions 16*a*, 16*b* projected toward frame 9 are formed at the bottom 16*c* of housing 16. As shown in FIG. 2, boss portions 16*a*, 16*b* are aligned by being inserted into small holes 9*a*, 9*b* formed on frame 9. As shown in FIG. 8, front wall 16A (side wall arranged opposite reeds) of housing 16 and back wall 16B are lower than partitions 15. Also, the surfaces facing each other become wider toward upper level (disk 3 side) such that they do not contact gears 13*a* of rotation pinwheels 13.

Figure 7:
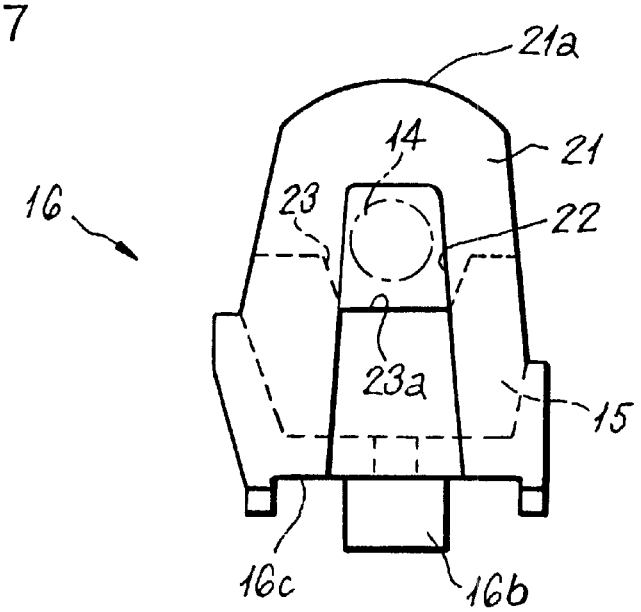
FIG. 7 is a side view showing the configuration of the housing in which pinwheels are inserted.
Figure 8:
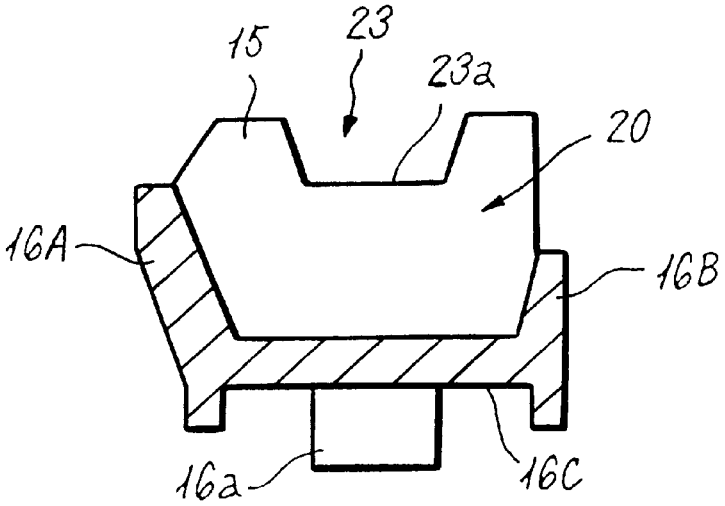
FIG. 8 is an A—A cross section of FIG. 6.

As shown in FIGS. 2, 6, 7, at the opposite end of disk 3 circumference of housing 16, alignment member 21 for aligning disk 3, which extends upward, is formed. Top 21*a* of alignment member 21 is kept at the same height as the half-circle shaped loader surface 10*a* on loader 10 attached to center shaft 170. Alignment member 21 keeps the disk 3 position constant by contacting the back side of disk 3 such that height (h) between disk 3 and pinwheels 13 is kept constant. (See FIG. 9.) Hole 22, in which pin shaft 14 is inserted, is formed on alignment member 21. Hole 22 is formed downward from a position such that it does not contact the upper surface of pin shaft 14 which is supported by bearings 17, 18 such that hole 22 does not contact pin shaft 14. Housing 16, partitions 15 and alignment member 21 are made integrally of a resin (e.g. polyacetal, Teflon) which is abrasion resistant and oil resistant.

As shown in FIG. 9, silicon grease 24 as a movement control agent is coated in space 20 of partitions 15. Silicon grease 24 provides control of rotation of each of the pinwheels 13 with its viscosity so that pinwheels 13 will not rotate too much.

Drive means 8 transfers with decreasing of the speed of rotation of motor 7, which is fixed onto L-shaped base plate 9A, to loader 10 as shown in FIGS. 1, 2, and 3. Thus, disk 3 which is loaded on loader 10 is rotated in the playing direction as marked with all arrow (a) around center shaft 170. Any types of gears used for drive means 8 are made of abrasion resistant resin.

In space X, worm wheel 31 is engaged with worm 30, which is fixed onto output shaft 7*a* of motor 7. Worm wheel 31 is fixed on one end of joint drive shaft 32, which acts as a communication means in space X. Joint drive shaft 32 is extended toward loader 10 almost parallel with pin shaft 14 and is rotatably supported by bearings 33, 34 formed on frame 9. Pinion 35 is fixed onto the end of joint drive shaft 32 located near bearing 34. Pinion 35 engaged with a large gear 36*a* of two step gear 36. Two step gear 36 is rotatably supported by a shaft (not illustrated) journaled onto frame 9 located under loader 10. A small gear 36*b* formed in the upper center of two step gear 36 is engaged with large gear 37 which is formed integral under loader 10.

Support member 40 is formed on L-shaped base plate 9A on frame 9 outside the rotary region of disk 3. Base end 6*a* of arm 6 is rotatably supported by rotation shaft 41, which is attached to support member 40. Plate spring 42 as an urging means which is engaged with rotation shaft 41. Plate spring 42 is breaking the speed of the rotation of arm 6 in the thickness direction of disk 3 and also urges arm 6 toward disk 3.

Figure 10:
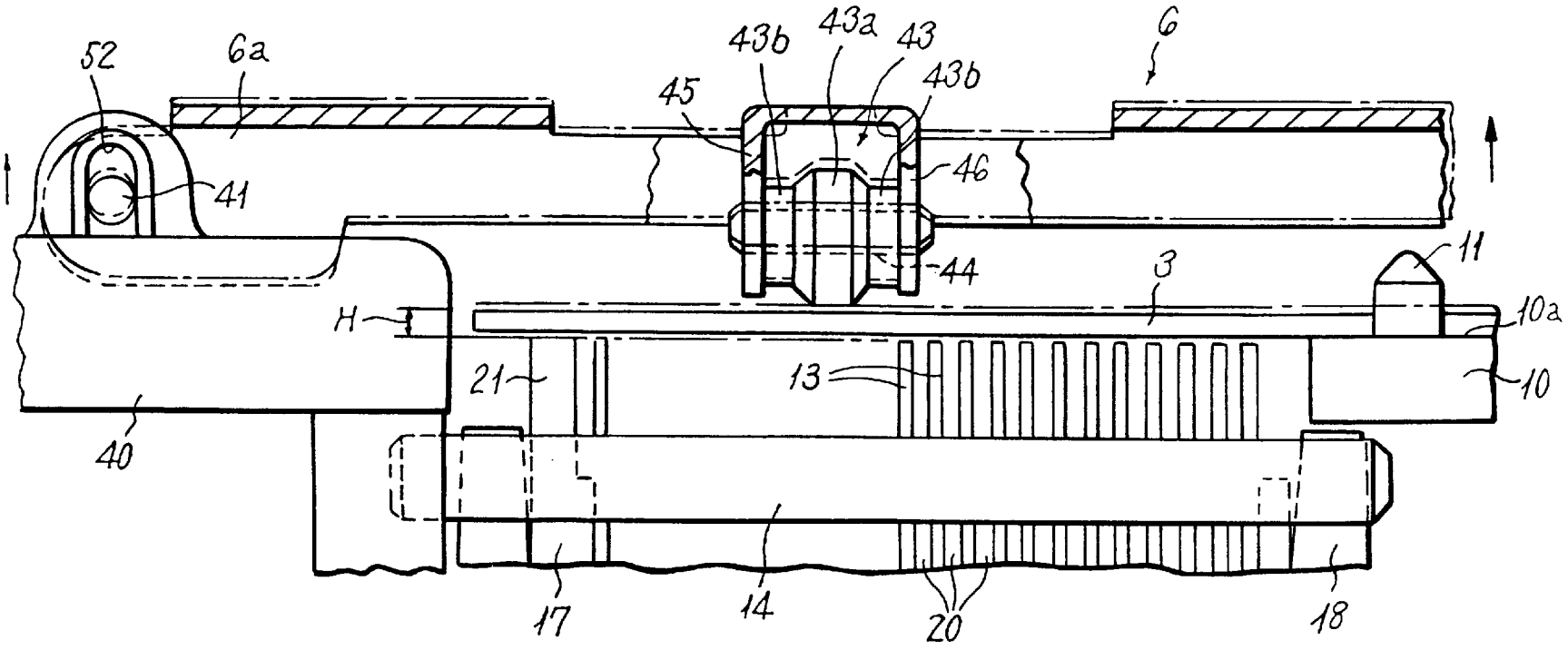
FIG. 10 is a magnified partial cross section showing the layout of an arm and how it works.

Arm 6 is a reversed U-shaped metallic plate in cross section. The center of the shaft direction of arm 6 is aligned with shaft center of pin shaft 14 and the arm is arranged opposite pinwheels 13. (See FIG. 14.) Arm 6 is formed such that it rotates around rotation shaft 41 within a plane including pin shaft 14, which is positioned at almost 90° of disk 3 above pinwheels 13. A pair of holes 56, in which rotation shaft 41 is inserted into side walls 6*b*, 6*c* of arm base ends 6*a*, are formed opposite each other. Press roller 43 (hereafter referred to as roller 43), as a contact member, is arranged in the center of arm 6. Roller 43 is made of a resin. Small diameter boss portions 43*b* at both ends are formed integral with large diameter portion 43*a* where disk 3 contacts, as shown in FIG. 10.

Roller 43 is arranged between a pair of bent portions 45, 46 formed by curving a part of arm 6 and is rotatably supported by shaft 44. Shaft 44 is lightly press fitted into rollers 43, and loosely engaged with bent portions 45, 46. Roller 43 is installed on arm 6 such that arm 6 contacts disk 3 was rotatably when arm 6 is engaged with center shaft 170 and gap h is formed between disk 3 and pinwheels 13.

Figure 11:
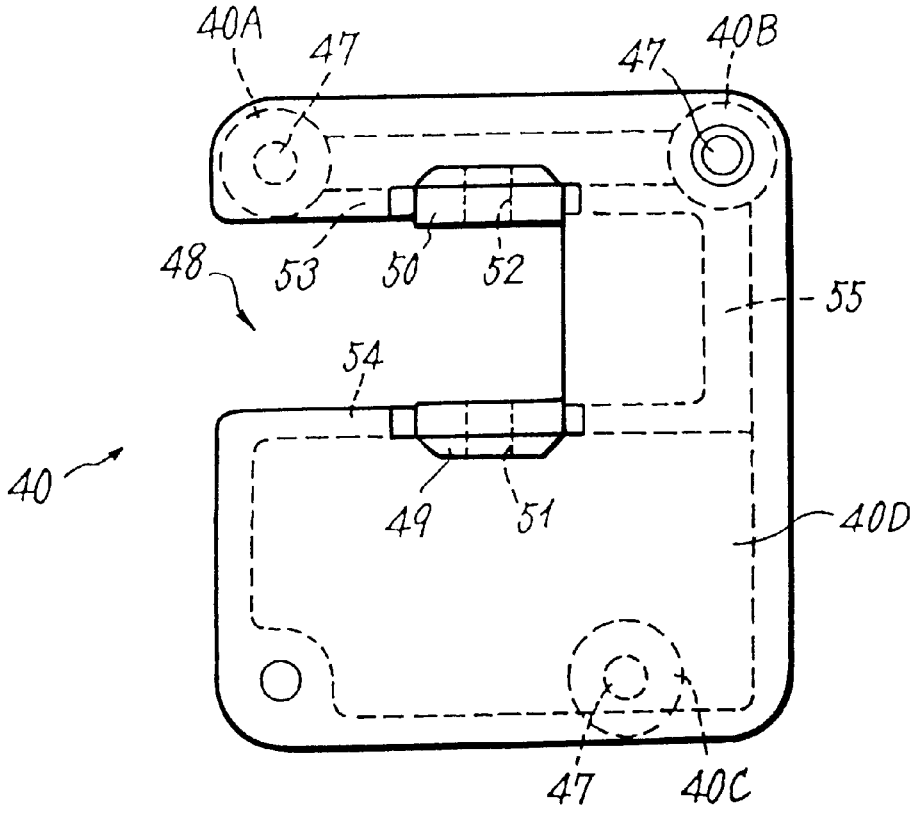
FIG. 11 is a plan view showing the layout of the support member to which an arm is installed.
Figure 12:
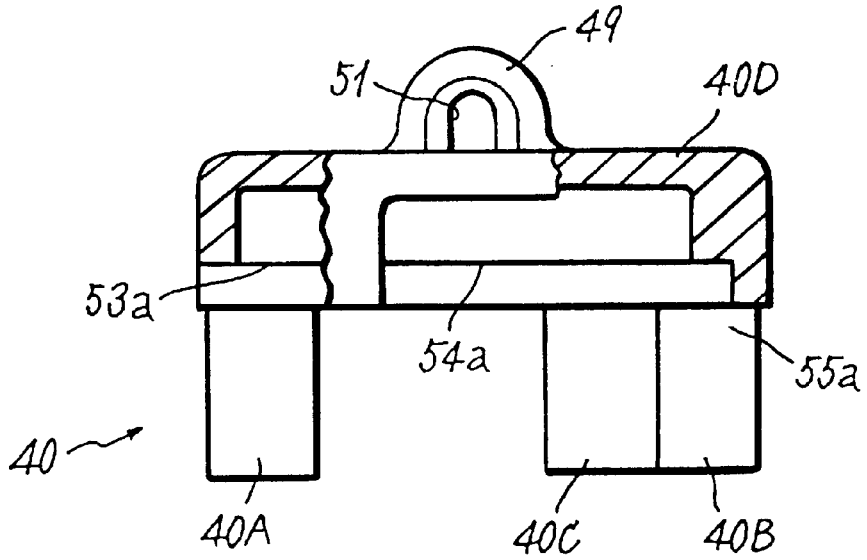
FIG. 12 is a partial front view showing the layout of a support member.
Figure 13:
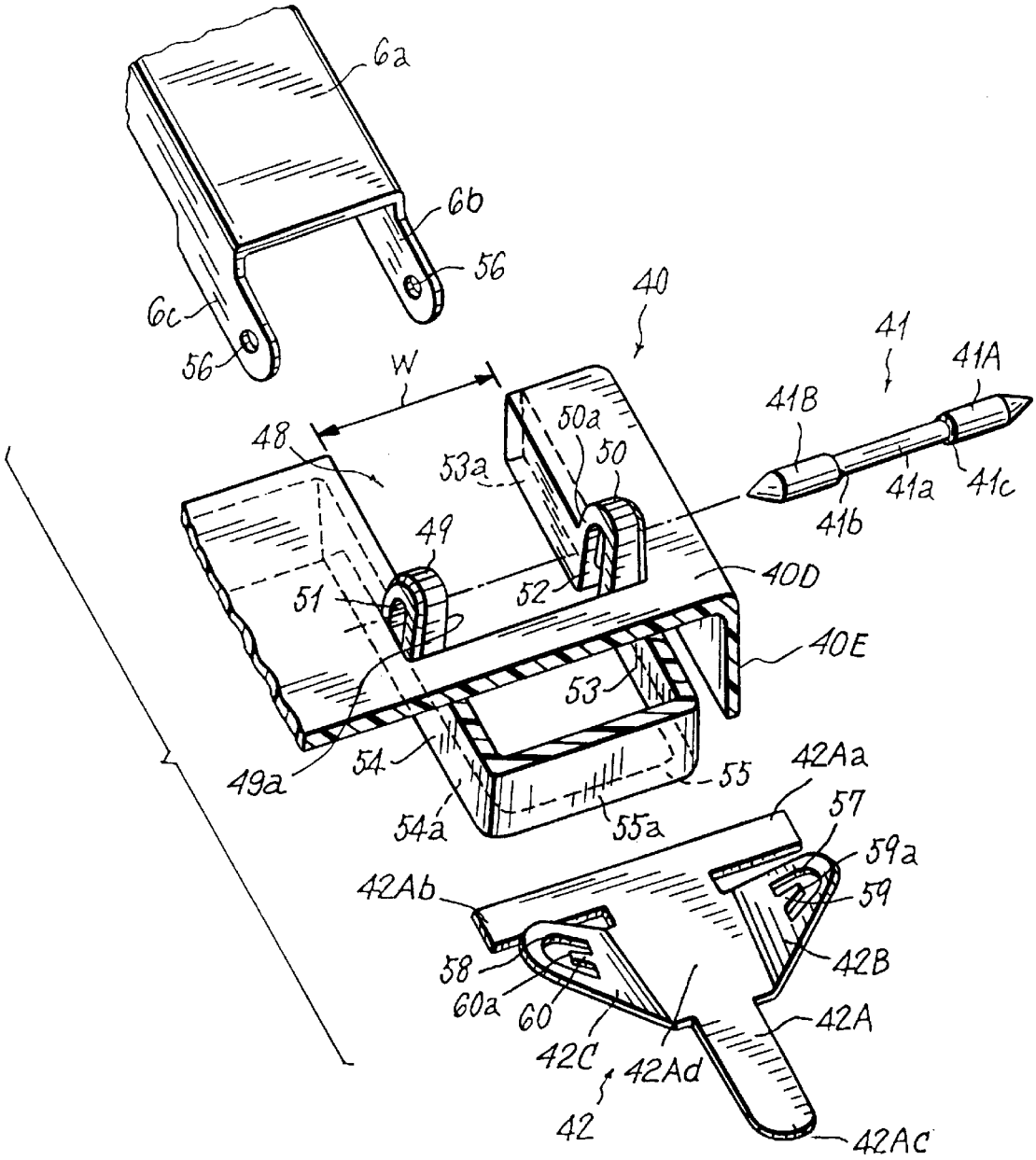
FIG. 13 is a disassembled perspective view showing the support mechanism of an arm.

In support member 40, three support legs 40A, 40B, 40C with screw holes 47 are extended downward as shown in FIGS. 11 and 12. Support member 40 is detachably supported by base plate 9A with screws 47 tightened from the base plate 9B side. Notch 48, into which base end 6*a* of arm 6 is inserted, is formed on upper surface 40D of support member 40 as shown in FIG. 13. A pair of extended portions 49, 50 are projected upward (perpendicular to base plate 9) facing each other at both ends of notch 48 on upper surface 40D.

Elongated holes 51, 52 as a guide means, which extend upward and downward, are formed on extended portions 49, 50. Under support member 40, walls 53, 54, 55 are continuously formed such that they surround notch 48. Walls 53, 54, 55 are formed lower than periphery 40E of support member 40. The lower surfaces 53*a*, 54*a*, 55*a* are engaged with plate spring 42. (See FIG. 14.) Support member 40, extended portion 49, 50, and each of the walls 53, 54, 55 are made of resin and formed integrally.

As shown in FIG. 13, center portion 41*a* of shaft 41 has a smaller diameter than both ends 41A, 41B and step portions 41*b*, 41*c* are formed at the border of each of the ends 41A, 41B. Tips of shaft 41 are tapered.

Figure 14:
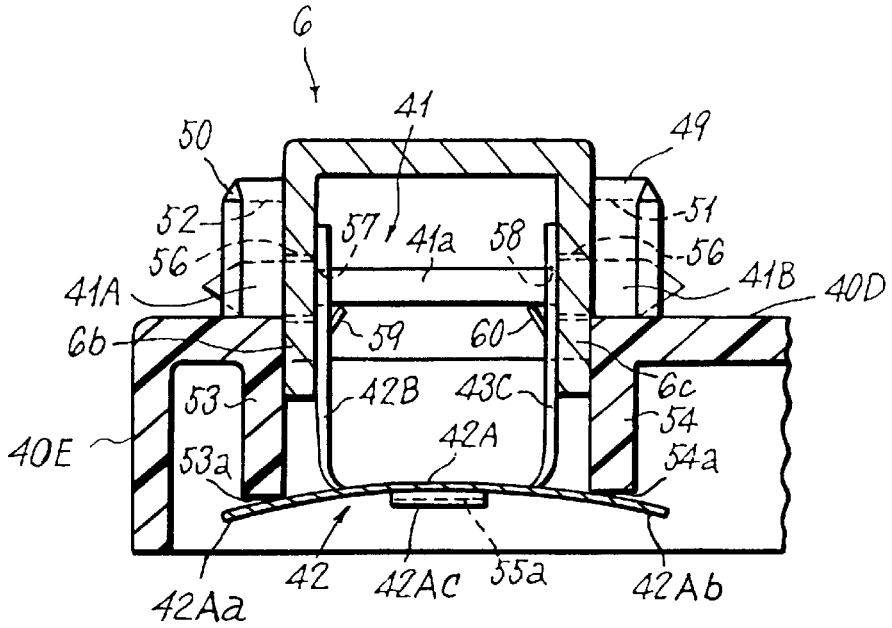
FIG. 14 is a magnified cross section showing how the urging means and the base end of an arm are attached viewed from the loader side.
Figure 15:
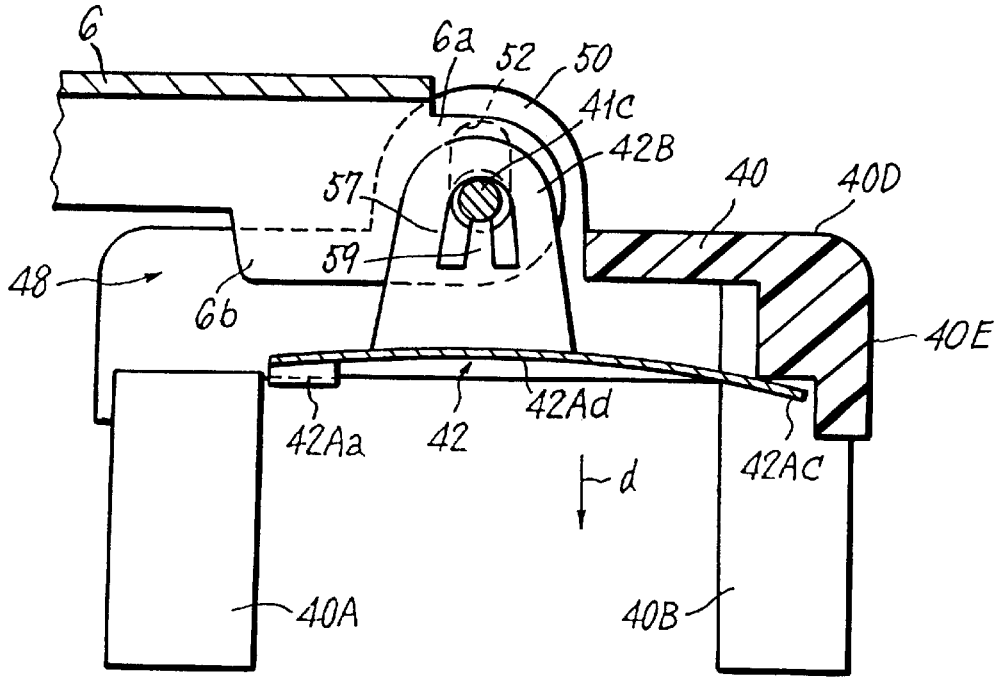
FIG. 15 is a magnified cross section showing how the urging means and the base end of an arm are attached.

Spring plate 42 is continuously formed with a pair of wing portions 42B, 42C, which are the support portion being engaged with shaft 41 at both sides of T-shaped body 42A. Wing portions 42B, 42C are bent and inserted to be engaged with side surfaces 6*b*, 6*c* of base 6*a*, which are spaced wider than width (W) of notch 48; the space is also the distance between extended portions 49, 50. Openings 57, 58, which shaft 41 is fitted through, are formed on wing portions 42B, 42C. When wing portions 42B, 42C are inserted into side surfaces 6*a*, 6*c* of arm 6, openings 57, 58 are arranged opposite each other on the same shaft center as shown in FIGS. 14 and 15.

Thin tangs 59, 60 which are engaged with step portions 41*b*, 41*c* of shaft 41, are formed inside openings 57, 58. Tangs 59, 60 occupy ⅔ height of openings 57, 58. Their tips 59*a*, 60*a* and inner circle of openings 57, 58 are narrower than the diameters of both ends 41A, 41B of shaft 41. Shaft 41 is stopped in the shaft direction by having step portions 41*b*, 41*c* being engaged with tang pieces 59, 60.

Both ends 42A*a*, 42A*b* of body portion 42A of plate spring 42 are engaged with lower surfaces 53*a*, 54*a* of walls 53, 54 and extended end 42A*c* of body portion 42A is engaged with lower surface 55*a* of wall 55 such that center 42A*d* warps in convex facing toward inside notch 48. In short, when shaft 41 is fitted through elongated holes 51, 52 of support member 40 and holes 56, 56 of arm 6 and openings 57, 58 of plate spring 42, and when arm 6 is supported by support member 40 via shaft 41, both ends 41A, 41B contact upper surface 40D of support member 40 and plate spring 42 urges force in the direction shown by arrow (d). As a result, both ends 41A, 41B contact lower surfaces 53*a*, 54*a*, 55*a* of each of the walls. Arm 6 is installed on support member 40 in this state.

Figure 16:
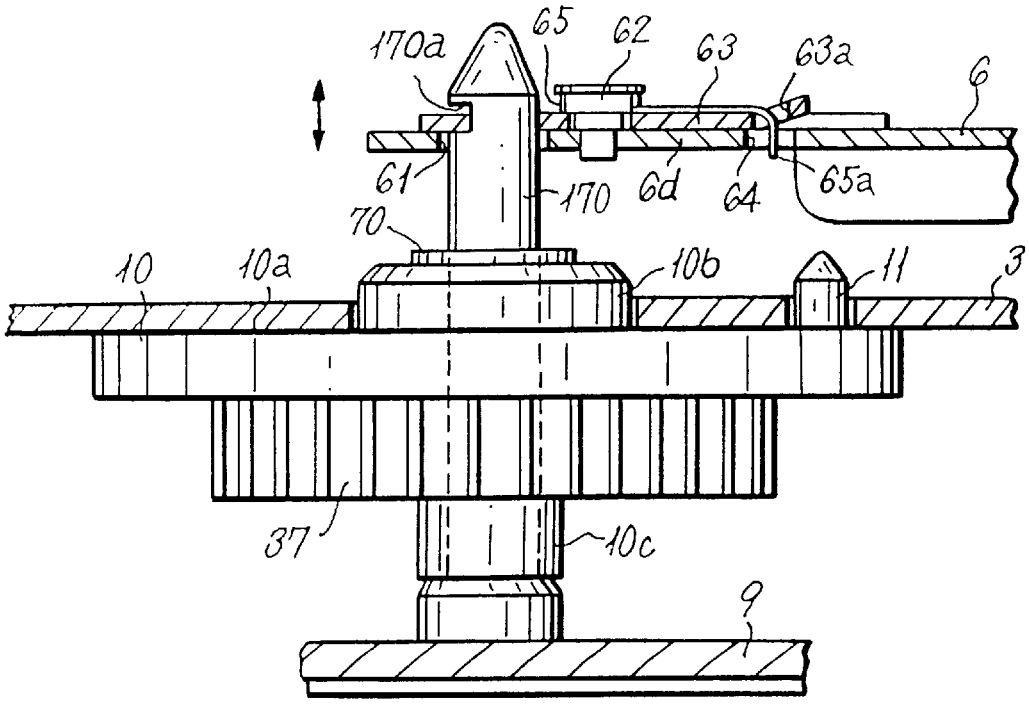
FIG. 16 is a magnified cross section showing the configuration of the tip structure of an arm and a loader.
Figure 17:
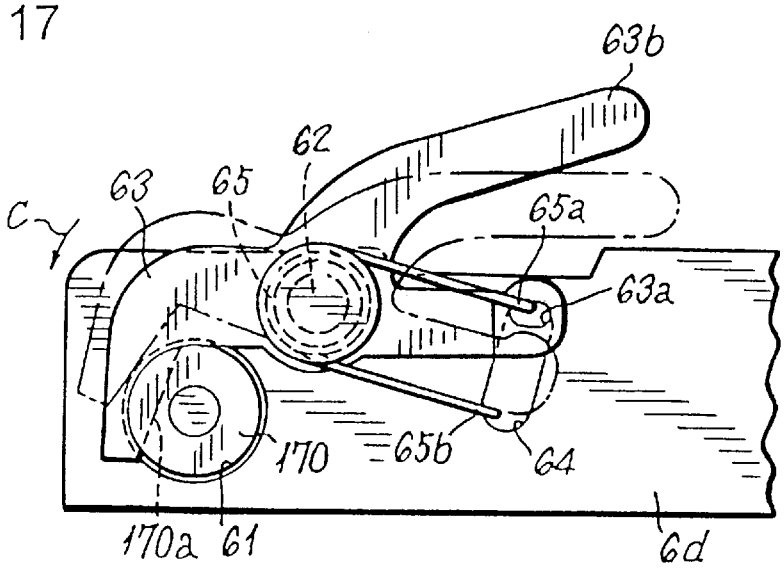
FIG. 17 is a magnified diagram showing how the tip o& an arm and a center shaft are engaged/disengaged.

As shown in FIGS. 16 and 17, at the tip side 6*d* of arm 6, hole 61, in which center shaft 170 is inserted, and engagement lever 63, which is rotatably supported by pin 62, are formed. Engagement lever 63 urges force, by coil spring 65 wound around pin 62, in the direction marked with an arrow (c) facing toward hole 61 of arm 6. One end 65*b* of coil spring 65 is engaged with elongated hole 64 formed on arm 6 and the other end 65*a* is engaged with spring hook 63*a* formed on lever 63. Once center shaft 170 is inserted into hole 61, lever 63 is engaged with groove 170*a* formed in the radius direction of center shaft 170 due to force urged via coil spring 65. Note that the tip of center shaft 170 is tapered to make insertion smooth.

Groove 170*a* is formed at the position at which pin shaft 14 is formed to support pinwheels 13 and arm 6 can be kept in parallel when it is engaged with engagement lever 63 and it tolerates up-down movement of engagement lever 63 in the shaft direction of shaft 170. Arm 6 is arranged parallel when it is engaged with center shaft 170 and sandwiches disk 3 with rollers 43 and pinwheels 13 by appropriately pressing the disk.

In a disk music box with this configuration, housing 16 is formed independent from frame 9. This makes it easier to assemble pin shaft 14 compared to the disk music box in which housing 16 is formed integral with frame 9. Pin shaft 14, which rotatably supports pinwheels 13, is fitted through housing 16 to be supported by bearings 17, 18 on frame 9. As a result, pin shaft 14 is directly supported on frame 9; this increases pin shaft 14 rigidity when it is mounted. Therefore, even if a large load is placed when reeds 5*a* are played, pin shaft 14 does not retreat; this makes pin portions 13*a* play reeds 5*a* accurately to provide a clear sound.

Openings 17*a*, 18*a* of bearings 17, 18, which support pin shaft 14, are formed upward to face the disk. Therefore, pin shaft 14 can be loaded onto bearings 17, 18 from top of frame 9 where disk 3 is located; this configuration makes assembly easier.

Alignment member 21 is made of abrasion resistant resin and is formed integral with housing 16, the amount of abrasion due to contact with disk 3 is reduced dramatically compared to a metallic member. This configuration can improve durability. At the same time, it can maintain distance (h) constant between pin portion 13*a* on top of pinwheels 13 and the reverse side of disk 3.

If distance (h) is constant, disk 3 can rotate stably due to the stable engagement of projections 2 of disk 3 and pinwheels 13. In this way, music can be played accurately while reducing abrasion noise or abrasion resistance generated during rotation of disk 3. Reduction of abrasion noise reduces noise against played sound, providing high quality sound. Reduction of abrasion resistance reduces the load onto the drive system; this stabilizes rotation of disk 3 and reduces power consumption. As a result, the time the disk music box is played is extended. By reducing abrasion of alignment member 21, frequency of parts replacement can be reduced, thus extending the usable life time of a disk music box.

By applying grease 24 onto partitions 15, rotation of pinwheels 13 can be controlled due to the viscous resistance of grease 24 when pinwheels 13 go through gap 20. Pinwheels 13 will not shake after playing reeds 5*a*. Vibrating tips 5*b* of reeds 5*a* and pin portions 13*a* will not interfere with each other, thus vibration of reeds 5*a* will not be interrupted providing poor sound quality. Or, noise called "broken sound" ( bire sound), which can be generated by pinwheels 13 when they receive vibration via frame 9, will not be generated. In other words, "broken sound" (bire sound) can be prevented, providing an excellent sound quality.

Grease 24 provides control of rotation of pinwheels 13. Compared to conventional technology, control projections and the like, which are engaged/disengaged with pin portions 13*a* are not required. This configuration requires simple machining and will not generate noise generated when control projections contacts pin portions 13*a*.

If control projections are not formed on housing 16, gap 20 may be narrowed to increase the magnitude of contact to control rotation of pinwheels 13, however, this increases abrasion noise. In addition, with a narrow gap 20, it is difficult to machine housing 16 to meet stringent specifications. Therefore, applying grease 24 to space 20 between partitions 15 is critical to meet stringent specifications required for housing 16 and to reduce manufacturing time and cost. In addition, grease 24 applied to the contact 25 area where housing 16 and frame 9 contact fills the gap which may be formed in contact area 25, thus controlling vibration with respect to frame 9.

How the disk music box is operated is described herein. Disk 3 is installed on the disk music box as follows:

Center hole 3*a* of disk 3 is inserted onto center shaft 170 and cylindrical portion 10*b* of loader 10.

Arm 6 is rotated in the direction marked with arrow (e) from the open state indicated with a two-dot line in FIG. 2;

Hole 61 of arm 6 is inserted over center shaft 170 as shown in FIG. 16.

Engagement lever 63, at which movement is urged in the direction marked with arrow (c) as indicated with a solid line in FIG. 17, moves toward release position as indicated with a two dot line.

When the center shaft 170 is inserted deeply, movement of engagement lever 63 is urged in the direction marked with arrow (c) so the tip of engagement lever 63 is engaged with groove 170*a* to hold arm 6.

Rollers 43 press top of disk 3 as shown in FIG. 10.

Disk 3 is sandwiched by rollers 43, loader surface 10*a*, and alignment member 21.

This operational step completes installation of disk 3.

Then, if a switch (not illustrated) is operated to rotate motor 7, rotation is decelerated to be transferred to large gear 37 formed on loader 10. When projections 2 are positioned above pinwheels 13 as disk 3 rotates, pinwheels 13, which are facing the projections 2, rotate one after another. Pins 13*a* of each of the pinwheels 13 are engaged with each of the projections 2 to play tips 5*b* of reeds 5*a* with pins portions 13*a* positioned thereunder, thus playing a melody.

The pressure point of a disk is released when removing or exchanging a disk. In other words, one end 63*b* of engagement lever 63 is moved clockwise to displace the tip of the lever from groove 170*a*. Then, arm 6 can be rotated in the direction it extends as indicated with arrow (f).

When disk 3 is installed, shaft 41 of arm 6 is supported by elongated holes 51, 52 extended in the up and down direction which is the thickness direction of disk 3. If disk 3 is thicker than set thickness as indicated with the two dot line in FIG. 10, rollers 43 are pushed up and arm 6 moves upward as indicated with a two dot line. Because arm 6 is movable in the thickness direction of disk 3, the dispersion of the thickness direction of disk 3 will be absorbed and this will not overload disk 3. Urging force from plate spring 42 works on shaft 41 which supports base end 6*a* of arm 6 in the direction indicated with arrow (d) and rollers 43 attached on arm 6 are pressed onto disk 3, correcting warping caused by rotation of disk 3 and maintaining space (h) between pinwheels 13 and disk 3 constant.

As described, if space (h) between pinwheels 13 and disk 3 is constant, projections 2 of disk 3 and pinwheels 13 are stably engaged, reducing the load on drive means 8. In this way, disk 3 rotates uniformly without damaging the melody. The load on power source 12 is also reduced to reduce power consumption, increasing the usable life time of a disk music box.

When rotating arm 6 in the direction indicted with arrows (e) and (f), wing portions 42B, 42C of plate spring 42 try to expand into base end 6*a*. As a result, side surfaces 6*b*, 6*c* of arm 6 are pressed onto inner surfaces 49*a*, 50*a* of extension portions 49, 50, increasing contact resistance between the two, controlling rotation of arm 6. In this way, movement of arm 6 can be stopped in the middle of its motion. This eliminate the necessity of holding arm 6 while operator is changing disk 3, providing easy-to-be-served configuration. In addition, when the disk music box is stood upright as in this embodiment, if arm 6 is released, arm 6 normally tends to fall under case 1 by its own weight. However, in this embodiment, arm 6 is protected from falling due to its own weight. There is little possibility for arm 6 to damage case 1 when arm 6 falls.

When placing a disk music box horizontally, arm 6 tends to move in the direction of disk 3 by its own weight depending on where it is. However, arm 6 movement is controlled, arm 6 itself or engagement lever 63 will not contact disk 3 to damage the same.

During assembly, arm 6 is rotatably installed on support member 40 as follows:

base 6*a* is arranged between extended portions 50, 51;

wing portions 42B, 42C are flexed between side surfaces 6*a*, 6*b;* shaft 41 is inserted through elongated holes 51 and openings 57, 58 of hole 56.

This configuration provides an easy assembly.

In the disk music box of the present invention, the pin shaft is directly supported on a frame, providing rigid mounting. This configuration prevents pinwheels from retreating, providing clear excellent sound quality. Because the opening portion of a bearing is formed at the disk side, the pin shaft can be installed onto the bearing from the disk side, providing an easy-to-service environment.

The described structure stabilizes the engagement state for pinwheels and engagement portions. In this way, the load to drive means is reduced, thus reducing power consumption and the disk can be rotated stably.

Also, the bent portion, the urging means, is likely to expand. The base end of the arm press contacts the side of a pair of expanded portions formed on the support member. This controls movement to stop the arm in the middle of its motion. This configuration provides an easy to install environment for the disk. There will be little possibility for the music box to be damaged.

While the foregoing description and drawings represent the preferred embodiments of the present invention, it will be obvious to those skilled in the art that various changes and modifications may be made therein without departing from the true spirit and scope of the present invention.

What is claimed is:

1. A disk music box comprising:

a disk having a plurality of engagement portions which correspond to a music selection;

a center shaft provided on a frame;

a loader on which said disk is loaded, said loader being rotatably supported by said center shaft;

a plurality of pinwheels, each of said pinwheels being independently supported by and rotatable around a pin shaft;

a reed portion comprising a comb having reeds arranged like a comb, said reed portion being played by said plurality of pinwheels when said plurality of pinwheels rotate around said pin shaft while engaging with said plurality of engagement portions on said disk;

an arm having a tip and a base end, said base end being rotatably supported on said frame and movable in a thickness direction of said disk, said tip being engaged with said center shaft so that said disk is positioned between said arm and said pinwheels;

a contact member for contacting said disk, said contact member being rotatably supported on said arm at a position between said tip and said base end;

urging means for urging said arm toward said frame so that said disk is pushed by said contact member on said arm; and guiding means for guiding said base end so as to be movable in the thickness direction of said disk.

2. The disk music box as set forth in claim 1, further comprising:

a support member for supporting said arm, said support member being provided on said frame, said support member having a elongated hole which is elongated in the thickness direction of said disk loaded on said loader; and a rotation shaft for rotatably supporting said base end of said arm, said rotation shaft fitted movably in said elongated hole, wherein said guiding means includes said elongated hole.

3. The disk music box as set forth in claim 2, wherein said rotation shaft is engaged with said urging means so that said urging means urges said rotation shaft onto an upper surface of said supporting member.

4. The disk music box as set forth in claim 1, further comprising a movement control means for controlling rotational movement of said arm with respect to said base end by said arm's own weight.

5. The disk music box as set forth in claim 2, wherein said arm is a plate arm with a U-shaped cross section, and said base end has a pair of side walls arranged opposite and a pair of holes through which said rotation shaft is supported.

6. The disk music box as set forth in claim 2, further comprising:

movement control means for controlling rotational movement of said arm around said rotation shaft due to said arm's own weight; and a plate spring member including said urging means and said movement control means, wherein said rotation shaft is engaged with said plate spring so that said urging means urges said rotation shaft onto an upper surface of said supporting member, and said movement control means pushes said base end of said arm against said support member in proximity of said elongated hole.

7. A disk music box comprising:

a metallic frame;

a disk with a plurality of engagement portions which correspond to a melody according to a music selection;

a loader for loading said disk and rotating integral with said disk, said loader being rotatably supported on said metallic frame;

a reed portion comprising a comb having reeds arranged like a comb, said comb being fixed on said metallic frame;

a plurality of pinwheels which pick said reeds to play said melody, and which are rotated as they are engaged with said engagement portions;

a pin shaft independently rotatably supporting each of said plurality of pinwheels;

a pair of bearings which support both ends of said pin shaft, said pair of bearings being formed on said metallic frame;

a housing having a holding portion for holding and positioning said housing with respect to said metallic frame; and a plurality of partitions for holding said pinwheels at predetermined positions, said partitions provided in said housing and arranged parallel in a shaft direction of said pin shaft.

8. The disk music box as set forth in claim 7 wherein said pair of bearings have U-shaped openings.

9. The disk music box as set forth in claim 7, wherein said partitions are coated with a movement control agent which controls rotation of said pinwheels.

10. The disk music box as set forth in claim 7, further comprising a positioning member which contacts the disk loaded on said loader at a predetermined position above an outer circle of said pinwheels, said positioning member being provided with said housing.

11. The disk music box as set forth in claim 7, wherein said housing is made of an abrasion resistant resin.

12. The disk music box as set forth in claim 7, further comprising a transfer means for transferring a driving power from a driving means to said loader, said transfer means being arranged between said reeds and said metallic frame.

13. A disk music box comprising:

a metallic frame;

a center shaft provided on said frame;

a disk with a plurality of engagement portions which correspond to a melody according to a music selection;

a loader on which said disk is loaded, said loader rotating integral with said disk, said loader being rotatably supported on said center shaft of said metallic frame;

a reed portion comprising a comb having reeds arranged like a comb, said comb being fixed on said metallic frame;

a plurality of pinwheels which pick said reeds to play said melody, and which are rotated as they are engaged with said engagement portions;

a pin shaft independently rotatably supporting each of said plurality of pinwheels;

a pair of bearings which support both ends of said pin shaft, said pair of bearings being formed on said metallic frame;

a housing having a holding portion for holding and positioning said housing with respect to said metallic frame;

a plurality of partitions for holding said pinwheels at predetermined positions, said partitions provided in said housing and arranged parallel in a shaft direction of said pin shaft;

an arm having a tip and a base end, said base end being rotatably supported on said frame and movable in a thickness direction of said disk, said tip being engaged with said center shaft so that said disk is positioned between said arm and said pinwheels;

a contact member for contacting said disk, said contact member being rotatably supported on said arm at a position between said tip and said base end;

an urging means for urging said arm toward said frame so that said disk is pushed by said contact member on said arm; and guiding means for guiding said base end so as to be movable in the thickness direction of said disk.

* * * * *